US009564705B2

(12) United States Patent
Arai et al.

(10) Patent No.: US 9,564,705 B2
(45) Date of Patent: Feb. 7, 2017

(54) WATERPROOF CONNECTOR

(71) Applicant: Japan Aviation Electronics Industry, Limited, Tokyo (JP)

(72) Inventors: Katsumi Arai, Tokyo (JP); Masayuki Kikuchi, Tokyo (JP); Masayuki Nishikata, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/424,010

(22) PCT Filed: Jun. 11, 2013

(86) PCT No.: PCT/JP2013/066071
§ 371 (c)(1),
(2) Date: Feb. 25, 2015

(87) PCT Pub. No.: WO2014/038261
PCT Pub. Date: Mar. 13, 2014

(65) Prior Publication Data

US 2015/0207264 A1 Jul. 23, 2015

(30) Foreign Application Priority Data

Sep. 4, 2012 (JP) ..... 2012-194112

(51) Int. Cl.
*H01R 12/00* (2006.01)
*H01R 13/52* (2006.01)
(Continued)

(52) U.S. Cl.
CPC ..... *H01R 13/5202* (2013.01); *H01R 13/405* (2013.01); *H01R 12/714* (2013.01); *H01R 13/521* (2013.01); *H01R 24/60* (2013.01)

(58) Field of Classification Search
CPC .. H01R 23/7073; H01R 13/5219; H01R 43/24
(Continued)

(56) References Cited

U.S. PATENT DOCUMENTS 4,029,388 A * 6/1977 Knoll ..... H01R 13/405 249/96
4,035,047 A * 7/1977 Ammon ..... H01R 13/42 439/733.1
(Continued)

FOREIGN PATENT DOCUMENTS

JP S62-121514 U 8/1987
JP 63-003916 1/1988
(Continued)

OTHER PUBLICATIONS

Office Action dated Aug. 22, 2016 issued in corresponding Finnish patent application No. 20155140 (6 pgs.).

*Primary Examiner* — Abdullah Riyami
*Assistant Examiner* — Thang Nguyen
(74) *Attorney, Agent, or Firm* — Muncy, Geissler, Olds & Lowe, P.C.

(57) ABSTRACT

A waterproof connector includes a housing that is formed of an insulating resin, and at least one contact that is integrally formed in the housing. The contact has at least one housing fixing unit that is disposed in a middle portion in the longitudinal direction of the contact and is embedded in the housing and fixed thereto, and a pair of overhanging portions that are respectively disposed at both ends of the housing fixing unit and overhang in a direction vertical to a longitudinal direction of the housing fixing unit. A portion of the housing that is in contact with the housing fixing unit is fitted between the pair of overhanging portions.

4 Claims, 8 Drawing Sheets

(51) Int. Cl.
*H01R 13/405* (2006.01)
*H01R 12/71* (2011.01)
*H01R 24/60* (2011.01)

(58) Field of Classification Search
USPC ..... 439/79, 271, 736, 606, 733.1
See application file for complete search history.

(56) References Cited

U.S. PATENT DOCUMENTS 4,887,353 A * 12/1989 Preputnick ..... H01R 12/725 29/830
6,206,735 B1 * 3/2001 Zanolli ..... H01R 12/585 439/404
6,506,083 B1 * 1/2003 Bickford ..... H01R 13/533 439/281
6,981,896 B2 * 1/2006 Su ..... H01R 13/652 439/606
7,553,171 B2 * 6/2009 Wang ..... H01R 13/4226 439/106
7,708,605 B2 * 5/2010 Shibata ..... H01R 13/41 439/733.1
7,901,247 B2 * 3/2011 Ring ..... H01R 13/405 439/606
8,876,538 B2 * 11/2014 Shiraishi ..... H01R 12/727 439/733.1
2002/0002007 A1 * 1/2002 Endo ..... H01R 9/091 439/625
2003/0214382 A1 * 11/2003 Tsuchida ..... H01C 10/44 338/162
2004/0192117 A1 * 9/2004 Mott ..... H01R 13/04 439/736
2007/0197059 A1 * 8/2007 Tanaka ..... H01R 12/7017 439/79

FOREIGN PATENT DOCUMENTS

JP H01-68814 5/1989
JP H05-1174 1/1993
JP 07-073916 A 3/1995
JP H0773916 * 3/1995 ..... H01R 23/7073
JP 07-245154 9/1995
JP 2003331969 A 11/2003
JP 2012-134130 7/2012

* cited by examiner

PRIOR ART

WATERPROOF CONNECTOR

TECHNICAL FIELD

The present invention relates to a waterproof connector, particularly to a waterproof connector in which a contact and a housing that is made of insulating resin are formed integrally with each other.

BACKGROUND ART

In recent years, there is a strong demand for waterproof function in various electronic devices and accordingly, waterproof connectors having waterproof property have been under development for the purpose of use in connection with an external device.

One example of such waterproof connectors is a connector in which a housing made of insulating resin is formed to be integral with a conductive contact to contain the same therein by, for example, insert molding. Owing to the integral molding, a surface of the contact adheres at the portion embedded in the housing to the insulating resin making up the housing and this prevents water from entering the inside of the connector from the outside of the connector through a boundary portion between the housing and the contact.

In general, however, a metal material making up the contact and a resin material making up the housing are different in thermal expansion coefficient from each other and therefore, when the connector is exposed to a high temperature environment during a soldering process in mounting the connector onto a circuit board of an electronic device for example, owing to the different expansion amount between the contact and the insulating resin, the insulating resin adhering to the surface of the contact may be separated therefrom. Once the insulating resin is separated, a gap is generated between the surface of the contact and the insulating resin and water may disadvantageously enter the inside of the connector through the gap even after the temperature falls to ambient temperature.

Aside from that, when a counter connector is fitted to a connector in which a contact and a housing are formed integrally with each other, the counter connector may be forcibly fitted in a direction oblique to the fitting axis, which is so-called "ill fitting," and a high stress may be applied to the portion between the housing and the contact. In this case, again, insulating resin making up the housing may be separated from a surface of the contact, which damages waterproof property of the connector.

To cope with it, for instance, Patent Literature 1 discloses a waterproof connector in which a tiny gap generated between a housing 1 and a contact 2 that are formed integrally with each other is filled with a waterproof sealant 3 to thereby improve waterproof property, as shown in FIG. 23.

CITATION LIST

Patent Literature

Patent Literature 1: JP 2012-134130 A

SUMMARY OF INVENTION

Technical Problems

However, in order to fill the waterproof sealant 3 in the tiny gap between the housing 1 and the contact 2, a complex apparatus is required for carrying out complex steps in which the connector is put in a liquid container retaining a liquid waterproof sealant to be immersed in the waterproof sealant after the contact 2 is fixed to the housing 1 by molding; the whole liquid container in this state is transported into a closed container of a decompression processing apparatus; and the pressure of the inside of the closed container is decreased by a vacuum pump to thereby evacuate the air present in the gap between the housing 1 and the contact 2 so that the gap is filled with the waterproof sealant in place of the air.

Furthermore, since the waterproof sealant adheres also to surfaces, including a contact portion, of the contact 2 through the immersion of the whole connector in the waterproof sealant, after the gap between the housing 1 and the contact 2 is filled with the waterproof sealant, the waterproof sealant adhering to the contact portion needs to be washed away by an ultrasonic washer or the like.

The present invention is aimed at solving the above problems of the prior art and providing a waterproof connector exhibiting excellent waterproof function without special treatment for improving waterproof property following integral molding of a housing with a contact.

Solution to Problems

A waterproof connector according to the present invention comprises a housing made of insulating resin, and at least one contact with which the housing is formed to be integral, the contact including one or more housing fixing portions provided at a middle portion of the contact in a length direction of the contact and embedded in the housing to be fixed to the housing, and a pair of overhanging portions separately provided at opposite ends of the housing fixing portion to overhang in a direction perpendicular to a length direction of the housing fixing portion, wherein the housing has a portion in contact with the housing fixing portion and the portion of the housing is sandwiched between the pair of overhanging portions.

The pair of overhanging portions may respectively overhang over an entire periphery of the contact with respect to the length direction of the housing fixing portion. Otherwise, the pair of overhanging portions may respectively overhang over part of a periphery of the contact in the direction perpendicular to the length direction of the housing fixing portion.

The housing fixing portions may be aligned along the length direction of the contact and the pair of overhanging portions are provided at opposite ends of each of the housing fixing portions.

Preferably, the pair of overhanging portions respectively have overhanging surfaces each connected to an end of the housing fixing portion and the portion of the housing in contact with the housing fixing portion being sandwiched between the overhanging surfaces. The pair of overhanging surfaces may extend in the direction perpendicular to the length direction of the housing fixing portion or in a direction inclined with respect to the length direction of the housing fixing portion.

The pair of overhanging portions may be embedded together with the housing fixing portion in the housing. Otherwise, the pair of overhanging portions may be disposed outside of the housing with at least a part of the overhanging surfaces being in contact with an outer surface of the housing.

Preferably, the contact has at its one end a contact portion formed to come into contact with a contact of a counter connector and at its another end a board attachment portion formed to be attached to a board, and wherein the housing fixing portion is provided between the contact portion and the board attachment portion.

It may be constructed that each of the pair of overhanging portions has a same area as that of the contact portion or the board attachment portion in a cross section perpendicular to the length direction of the contact whereas the housing fixing portion is smaller in cross-sectional area than each of the pair of overhanging portions. Otherwise, each of the housing fixing portion and the pair of overhanging portions may have a same area as that of the contact portion or the board attachment portion in a cross section perpendicular to the length direction of the contact and the pair of overhanging portions may be formed at the opposite ends of the housing fixing portion by bending the contact.

Preferably, fine irregularities are formed at a surface of the housing fixing portion for increasing an anchoring effect between the housing fixing portion and the housing.

The contact may be composed of a flat plate member or a pin member having a circular cross section.

Advantageous Effects of Invention

According to the present invention, the contact has the pair of overhanging portions separately provided at the opposite ends of the housing fixing portion embedded in the housing, and the housing has a portion in contact with the housing fixing portion, the portion of the housing being sandwiched between the pair of overhanging portions. Therefore, even though special treatment for improving waterproof property is not performed after integral molding of the housing with the contact, it is possible to exhibit excellent waterproof function.

DESCRIPTION OF EMBODIMENTS

Embodiments of the present invention will be described below based on the appended drawings.

Embodiment 1

Figure 1:
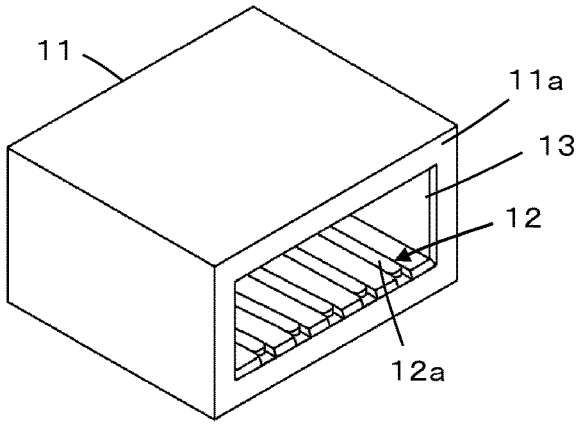
FIG. 1 is a perspective view showing a waterproof connector according to Embodiment 1 of the present invention when viewed obliquely from the front.
Figure 2:
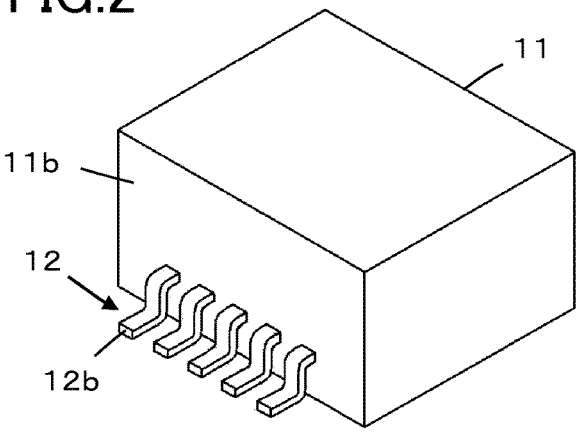
FIG. 2 is a perspective view showing the waterproof connector according to Embodiment 1 when viewed obliquely from the rear.

FIG. 1 shows the structure of a waterproof connector according to Embodiment 1 of the present invention. The waterproof connector includes a housing 11 having a cuboid outer shape and a plurality of contacts 12 fixed to the housing 11. A counter-connector receiving portion 13 having a concave shape is formed in the housing 11 to open at a front surface 11*a* of the housing 11 and a contact portion 12*a* provided at the front end of each contact 12 is placed inside the counter-connector receiving portion 13 of the housing 11. The counter-connector receiving portion 13 of the housing 11 is a space for receiving a counter connector to be fitted with the waterproof connector according to Embodiment 1. On the other hand, a board attachment portion 12*b* provided at the rear end of each contact 12 extends out of the housing 11 from a rear surface llb of the housing 11 as shown in FIG. 2.

Figure 3:
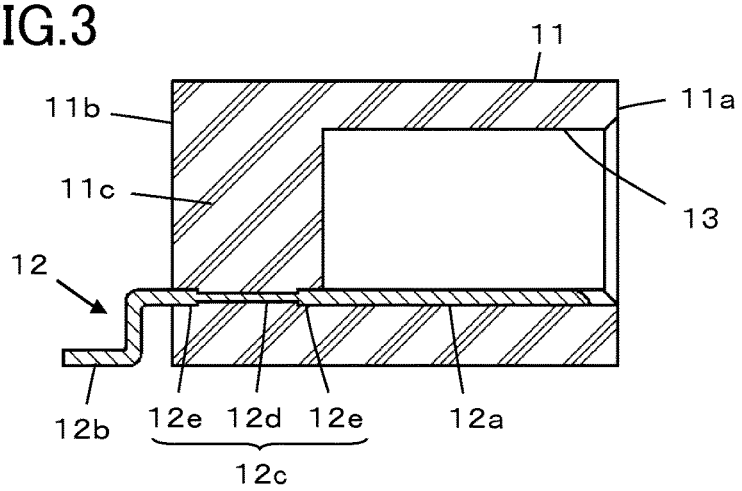
FIG. 3 is a cross-sectional view showing the waterproof connector according to Embodiment 1.

As shown in FIG. 3, the housing 11 has a rear wall 11*c* present between the innermost portion of the counter-connector receiving portion 13 and the rear surface llb of the housing 11. The contacts 12 penetrate the rear wall 11*c* of the housing 11 and are thereby supported by the housing 11. The contact portions 12*a* of the contacts 12 placed inside the counter-connector receiving portion 13 of the housing 11 are portions to be in contact with the corresponding contacts of the counter connector fitted in the counter-connector receiving portion 13, while the board attachment portions 12*b* extending outward from the rear surface 11*b* of the housing 11 are portions used for attaching the contacts 12 to the board on which the waterproof connector is to be mounted and for establishing the conduction.

Figure 4:
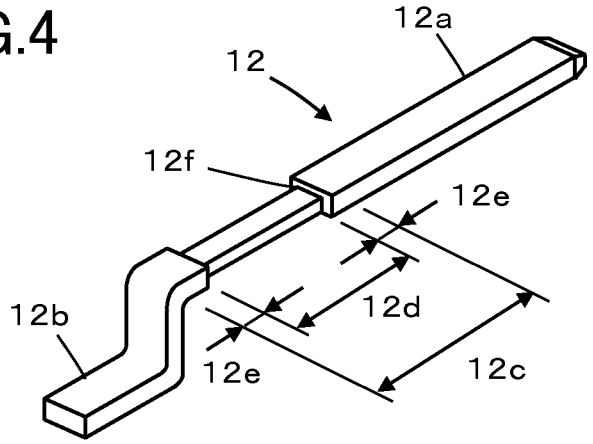
FIG. 4 is a perspective view showing a contact used in the waterproof connector according to Embodiment 1.

Each of the contacts 12 is composed of a flat plate member and has an embedment portion 12*c* formed between the contact portion 12*a* and the board attachment portion 12*b* as shown in FIG. 4. The embedment portion 12*c* is a portion to be embedded in the rear wall 11*c* when the contact penetrates the rear wall 11*c* of the housing 11 as shown in FIG. 3. A housing fixing portion 12*d* is formed at the middle of the embedment portion 12*c* and a pair of overhanging portions 12*e* are separately provided at the opposite ends of the housing fixing portion 12*d*. The housing fixing portion 12*d* and the pair of overhanging portions 12*e* constitute the embedment portion 12*c*.

The pair of overhanging portions 12*e* are continuous with the contact portion 12*a* and the board attachment portion 12*b* of the contact 12, respectively. The overhanging portions 12*e* each have the same area as that of the contact portion 12*a* or the board attachment portion 12*b* of the contact 12 in a cross section perpendicular to the length direction of the contact 12, whereas the housing fixing portion 12*d* is smaller in cross-sectional area than the overhanging portion 12*e*. In other words, the housing fixing portion 12*d* is constricted relative to the overhanging portions 12*e* provided at the opposite ends of the housing fixing portion. Each of the overhanging portions 12*e* overhangs in the direction perpendicular to the length direction of the housing fixing portion 12*d* over the entire periphery of the contact.

A difference in level is formed at the boundary part between either of the overhanging portions 12*e* and the housing fixing portion 12*d*. The overhanging portions 12*e* each have an overhanging surface 12*f* connected to an either end of the housing fixing portion 12*d* and extending in the direction perpendicular to the length direction of the housing fixing portion 12*d*.

The housing 11 is made of, for example, a resin material having insulation property and formability and the contacts 12 are made of a metal material having conductivity.

The housing 11 is formed to be integral with the contacts 12 by setting the contacts 12 in a mold which is not shown, closing the mold, pouring molten insulating resin material into the mold and cooling the mold, whereby the waterproof connector as shown in FIGS. 1 to 3 is manufactured.

Figure 5:
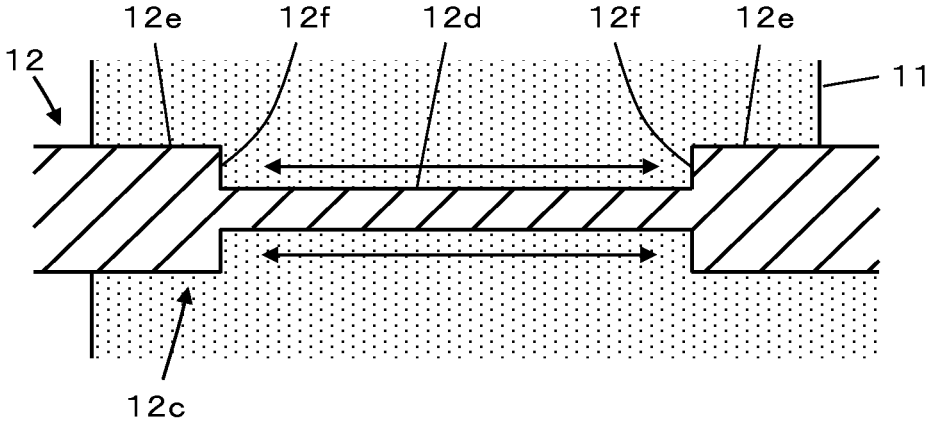
FIG. 5 is a cross-sectional view showing an embedment portion of the contact embedded in a housing of the waterproof connector according to Embodiment 1.

Owing to the integral molding of the housing 11 with the contacts 12, the insulating resin making up the housing 11 adheres to the surfaces of the embedment portions 12*c* of the contacts 12 embedded in the rear wall 11*c* of the housing 11. At this time, since the housing fixing portion 12*d* of the contact 12 has a smaller area in a cross section perpendicular to the length direction of the contact 12 than the area of either of the overhanging portions 12*e* at the opposite ends of the housing fixing portion, of the insulating resin making up the housing 11, the portion in contact with the surfaces of the housing fixing portion 12*d* is sandwiched between the pair of overhanging portions 12*e* as shown in FIG. 5. More specifically, the insulating resin is sandwiched between the overhanging surfaces 12*f* of the pair of overhanging portions 12*e*.

The insulating resin material making up the housing 11 is generally has a greater thermal expansion coefficient than that of the metal material making up the contacts 12 and therefore, when the waterproof connector is exposed to a high temperature environment in, for example, soldering the board attachment portion 12*b* of the contact 12 onto a wiring pattern of a circuit board, the insulating resin in contact with the housing fixing portion 12*d* of the contact 12 tries to expand more than the housing fixing portion 12*d* as indicated by arrows in FIG. 5.

However, the insulating resin is sandwiched between the overhanging surfaces 12*f* of the pair of overhanging portions 12*e* and this configuration prevents the amount of expansion of the insulating resin in contact with the surfaces of the housing fixing portion 12*d* from becoming larger than the amount of expansion of the housing fixing portion 12*d*. As a result, the separation of the insulating resin from the surfaces of the housing fixing portion 12*d* due to a stress applied between the surfaces of the housing fixing portion 12*d* and the insulating resin in the length direction of the housing fixing portion 12*d* is avoided, thus maintaining the adhesion between the surfaces of the housing fixing portion 12*d* and the insulating resin.

Therefore, a gap is not generated between the surfaces of the housing fixing portion 12*d* and the insulating resin, so that excellent waterproof function is exhibited between the housing 11 and the contacts 12.

Furthermore, even when a counter connector is forcibly fitted in a direction oblique to the fitting axis, which is so-called "ill fitting," in fitting operation of the connector with the counter connector, owing to the insulating resin sandwiched between the overhanging surfaces 12*f* of the pair of overhanging portions 12*e*, a stress is inhibited from being concentrated at a portion between the surfaces of the housing fixing portion 12*d* and the insulating resin, thus avoiding the separation of the insulating resin from the surfaces of the housing fixing portion 12*d*. Therefore, excellent waterproof function is maintained.

Figure 6:
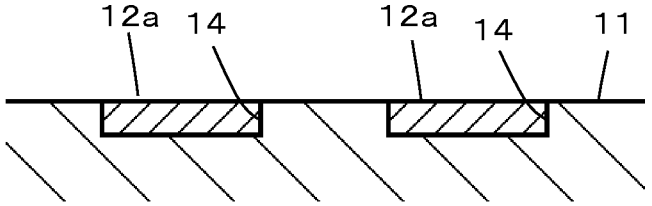
FIG. 6 is a cross-sectional view showing contact portions of the contacts accommodated in grooves of the housing.

A plurality of grooves 14 are formed at the bottom of the inside of the counter-connector receiving portion 13 of the housing 11 to correspond to the contacts 12 as shown in FIG. 6 and the contact portions 12*a* of the contacts 12 are respectively accommodated in the corresponding grooves 14. Therefore, even when a stress is applied to a contact portion 12*a* of any of the contacts 12 in a direction toward an adjacent contact 12 due to some cause at the time of, for example, fitting with the counter connector, the corresponding groove 14 limits movement of the contact portion 12*a* of the contact 12, thereby preventing defects such as a short-circuit between adjacent contacts 12.

Figure 7:
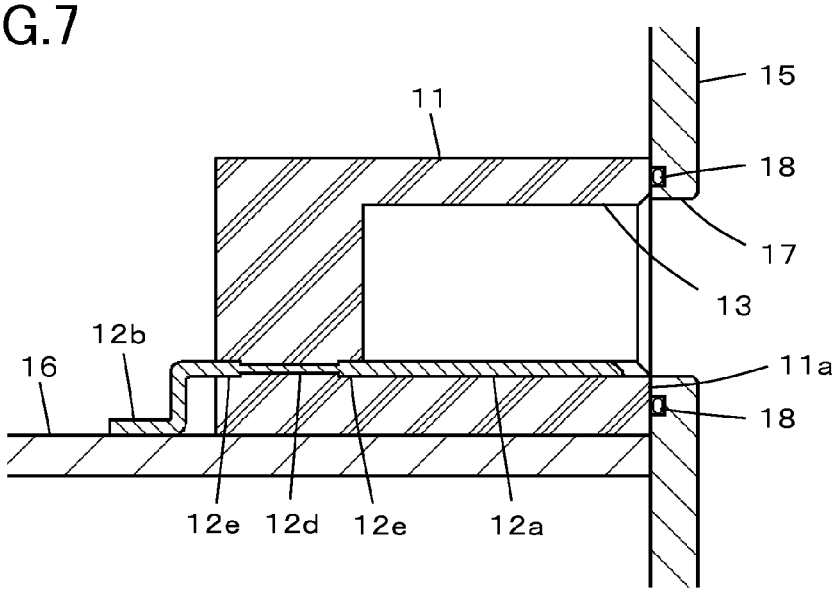
FIG. 7 is a cross-sectional view showing the state in which the waterproof connector according to Embodiment 1 is mounted on a board.

As shown in FIG. 7, for instance, the waterproof connector according to Embodiment 1 is mounted for use on a board 16 disposed in a casing 15 of an electrical device such as a mobile phone. An opening 17 is formed at the casing 15 to correspond to the counter-connector receiving portion 13 of the housing 11 and a gasket 18 is disposed along the periphery of the opening 17 to seal between an inner surface of the casing 15 and the front surface 11*a* of the housing 11.

The configuration described above prevents moisture existing outside the casing 15 from entering the inside of the casing 15 through the counter-connector receiving portion 13 of the housing 11 because the adhesion is maintained between the surfaces of the housing fixing portion 12*d* of the contact 12 and the insulating resin making up the rear wall 11*c* of the housing 11, while the gasket 18 serves to keep moisture from entering the inside of the casing 15 through a gap between the casing 15 and the housing 11, thus making it possible to achieve waterproof function.

As described above, in the waterproof connector according to Embodiment 1, the housing 11 is formed to be integral with the contact 12 in which the overhanging portions 12*e* are separately provided at the opposite ends of the housing fixing portion 12*d* whereby the insulating resin in contact with the housing fixing portion 12*d* is sandwiched between the pair of overhanging portions 12*e*. As a result, even though special treatment for improving waterproof property is not performed after integral molding of the housing 11 with the contacts 12, it is possible to avoid the separation of the insulating resin from the surfaces of the housing fixing portion 12*d* which may occur at high temperature during, for example, a soldering process and for the ill fitting in which a counter connector is forcibly fitted in an oblique direction, thus maintaining the adhesion between the housing fixing portion 12*d* and the insulating resin and exhibiting excellent waterproof function.

It should be noted that while the five contacts 12 are disposed in the housing 11 in FIGS. 1 and 2, the number of the contacts 12 is not limited to five and may be one to four or six or more.

In addition, while the housing 11 of the waterproof connector has, for instance, a height of 4 mm and a depth from the front surface 11*a* to the rear surface 11*b* of 5 mm and has the rear wall 11*c* with a thickness of about 1 mm to about 2 mm, the size of the housing 11 is not limited thereto.

Embodiment 2

Figure 8:
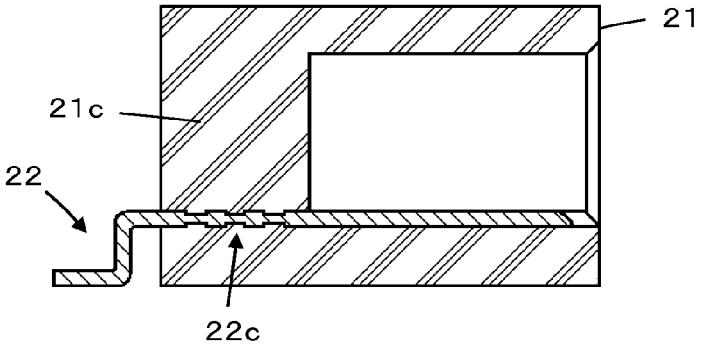
FIG. 8 is a cross-sectional view showing a waterproof connector according to Embodiment 2.

FIG. 8 shows a waterproof connector according to Embodiment 2. A housing 21 made of insulating resin and a contact 22 are formed integrally with each other and an embedment portion 22*c* of the contact 22 is embedded in a rear wall 21*c* of the housing 21 in the same manner as the waterproof connector in Embodiment 1.

Figure 9:
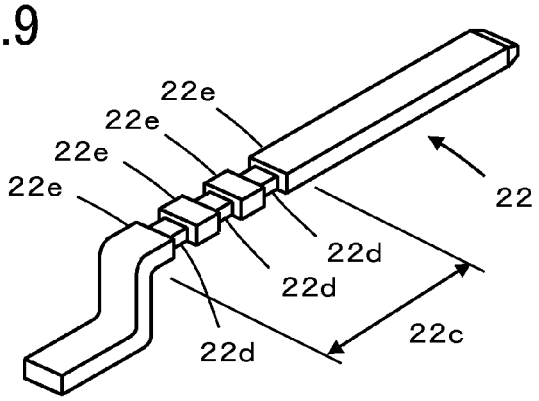
FIG. 9 is a perspective view showing a contact used in the waterproof connector according to Embodiment 2.

However, as shown in FIG. 9, three housing fixing portions 22*d* are aligned at the embedment portion 22*c* of the contact 22, and overhanging portions 22*e* are formed at the opposite ends of each of the housing fixing portions 22*d*. Each of the overhanging portions 22*e* has a larger area in a cross section perpendicular to the length direction of the contact 22 than the area of each of the housing fixing portions 22*d* and overhangs in the direction perpendicular to the length direction of the housing fixing portions 22*d* over the entire periphery of the contact.

Since the contact 22 as described above and the housing 21 are formed integrally with each other, the insulating resin making up the housing 21 adheres to the surfaces of the embedment portion 22*c* of the contact 22 while the insulating resin in contact with the surfaces of each of the housing fixing portions 22*d* is sandwiched between the overhanging portions 22*e* disposed at the opposite ends of the relevant housing fixing portion 22*d*. Therefore, even when the waterproof connector is exposed to a high temperature environment during, for example, a soldering process in which the connector is soldered to a circuit board, the amount of expansion of the insulating resin in contact with the surfaces of the housing fixing portions 22*d* is prevented from becoming larger than the amount of expansion of the housing fixing portions 22*d*. Furthermore, even when a counter connector is forcibly fitted in a direction oblique to the fitting axis, a stress is inhibited from being concentrated at a portion between the surfaces of the housing fixing portions 22*d* and the insulating resin. Thus, the separation of the insulating resin from the surfaces of the housing fixing portions 22*d* is avoided and excellent waterproof function is exhibited.

In Embodiment 2, the three housing fixing portions 22*d* are aligned at the embedment portion 22*c* of the contact 22 and therefore, the length of one housing fixing portion 22*d* is reduced. Accordingly, an expanding force of the insulating resin corresponding to one housing fixing portion 22*d* at high temperature can be suppressed to a lower level. Furthermore, even with the reduced length of one housing fixing portion 22*d*, the three housing fixing portions 22*d*, as a whole, can adhere to the insulating resin with a wide area. Therefore, it is possible to effectively avoid the separation of the insulating resin from the housing fixing portions 22*d* which may occur at high temperature and during the ill fitting, thus improving waterproof function.

The number of the housing fixing portions 22*d* at the embedment portion 22*c* is not limited to three and may be two or four or more.

Embodiment 3

While in Embodiments 1 and 2 described above, the overhanging portion 12*e* or 22*e* of the contact 12 or 22 overhangs over the entire periphery of the contact in the direction perpendicular to the length direction of the housing fixing portion 12*d* or 22*d*, the invention is not limited thereto and the overhanging portion may overhang over part of the periphery of the contact in the direction perpendicular to the length direction of the housing fixing portion.

Figure 10:
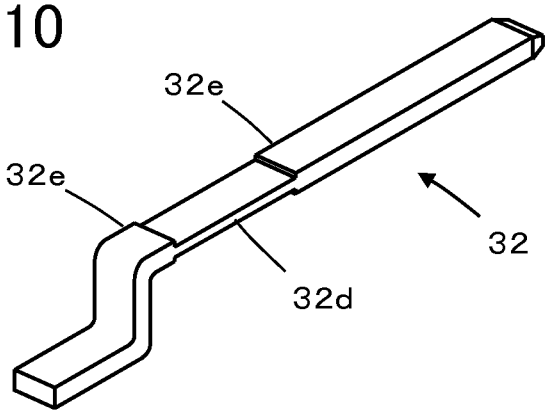
FIG. 10 is a perspective view showing a contact used in a waterproof connector according to Embodiment 3.

For instance, as shown in FIG. 10, a pair of overhanging portions 32*e* are separately formed at the opposite ends of a housing fixing portion 32*d* of a contact 32 composed of a flat plate member so as to overhang from the housing fixing portion 32*d* in the thickness direction of the flat plate member, and the housing is formed to be integral with the contact 32 so that the housing fixing portion 32*d* and the pair of overhanging portions 32*e* are embedded in the housing. With this configuration, the insulating resin making up the housing adheres to the surfaces of the housing fixing portion 32*d* and those of the overhanging portions 32*e* while the insulating resin in contact with the surfaces of the housing fixing portion 32*d* facing in the thickness direction of the housing fixing portion 32*d* is sandwiched between the pair of overhanging portions 32*e*, thereby improving waterproof function similarly to Embodiments 1 and 2.

Figure 11:
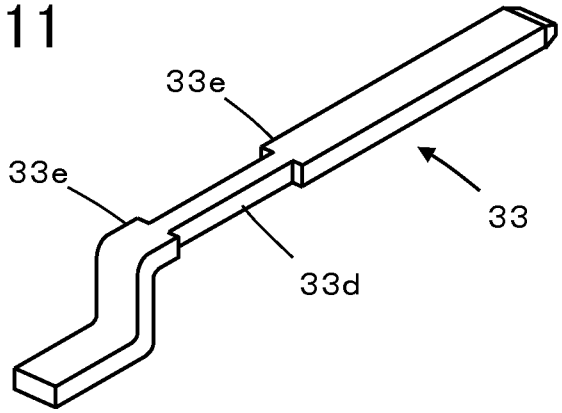
FIG. 11 is a perspective view showing a contact used in a waterproof connector according to a modification of Embodiment 3.

Alternatively, as shown in FIG. 11, a pair of overhanging portions 33*e* may be separately formed at the opposite ends of a housing fixing portion 33*d* of a contact 33 composed of a flat plate member so as to overhang from the housing fixing portion 33*d* in the width direction of the flat plate member. The housing is formed to be integral with the contact 33 so that the housing fixing portion 33*d* and the pair of overhanging portions 33*e* are embedded in the housing. Also with this configuration, the insulating resin making up the housing adheres to the surfaces of the housing fixing portion 33*d* and those of the overhanging portions 33*e* while the insulating resin in contact with the surfaces of the housing fixing portion 33*d* facing in the width direction of the housing fixing portion 33*d* is sandwiched between the pair of overhanging portions 33*e*, thereby improving waterproof function.

Figure 12:
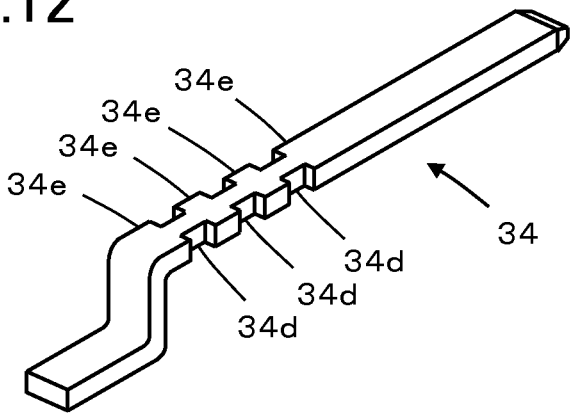
FIG. 12 is a perspective view showing a contact used in a waterproof connector according to another modification of Embodiment 3.

Still alternatively, as shown in FIG. 12, the configuration may be employed in which a plurality of housing fixing portions 34*d* are aligned at a contact 34 composed of a flat plate member and overhanging portions 34*e* are separately formed at the opposite ends of each of the housing fixing portions 34*d* so as to overhang from the housing fixing portion 34*d* in the width direction of the flat plate member. The housing is formed to be integral with the contact 34 so that the housing fixing portions 34*d* and the overhanging portions 34*e* are embedded in the housing. With this configuration, again, the insulating resin making up the housing adheres to the surfaces of the housing fixing portions 34*d* and those of the overhanging portions 34*e* while the insulating resin in contact with the surfaces of each of the housing fixing portions 34*d* facing in the width direction of the housing fixing portions 34*d* is sandwiched between the overhanging portions 34*e* disposed at the opposite ends of the relevant housing fixing portion 34*d*, thereby improving waterproof function.

While in the contact 34 shown in FIG. 12, the three housing fixing portions 34*d* are aligned, the number of the housing fixing portions 34*d* may be two or four or more.

Yet still alternatively, also with the configuration in which a plurality of housing fixing portions are aligned and a pair of overhanging portions are formed at the opposite ends of each of the housing fixing portions so as to overhang from the housing fixing portion in the thickness direction of the flat plate member as with the contact 32 shown in FIG. 10, a waterproof connector having excellent waterproof function can be obtained.

Embodiment 4

Figure 13:
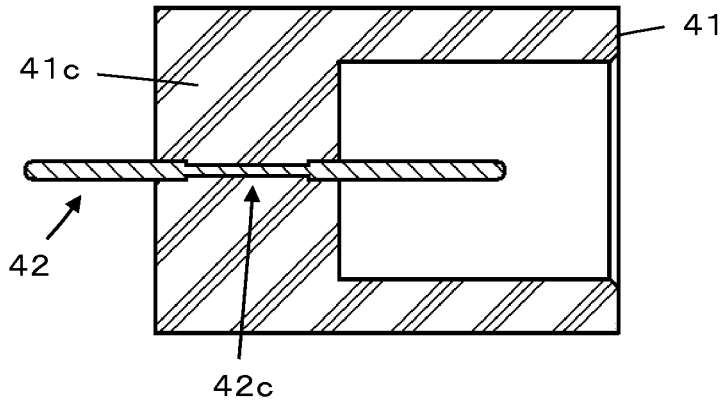
FIG. 13 is a cross-sectional view showing a waterproof connector according to Embodiment 4.

FIG. 13 shows a waterproof connector according to Embodiment 4. A housing 41 made of insulating resin and a contact 42 are formed integrally with each other and an embedment portion 42*c* of the contact 42 is embedded in a rear wall 41*c* of the housing 41.

Figure 14:
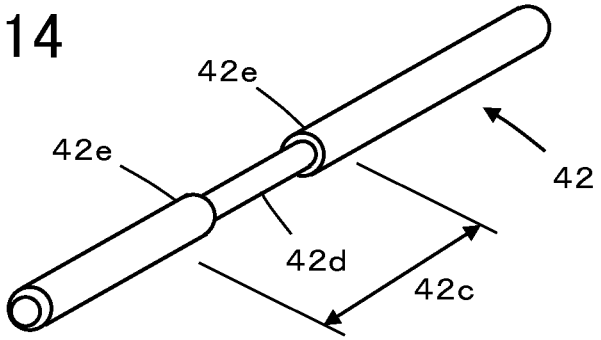
FIG. 14 is a perspective view showing a contact used in the waterproof connector according to Embodiment 4.

However, the contact 42 is composed of not a flat plate member but a pin member having a circular cross section as shown in FIG. 14. A housing fixing portion 42*d* having a circular cross section is formed at the embedment portion 42*c* of the contact 42, and overhanging portions 42*e* having a circular cross section larger in diameter than that of the housing fixing portion 42*d* are separately formed at the opposite ends of the housing fixing portion 42*d*.

Also with this configuration, the insulating resin making up the housing 41 adheres to the surfaces of the embedment portion 42*c* of the contact 42 while the insulating resin in contact with the outer peripheral surface of the housing fixing portion 42*d* is sandwiched between the pair of overhanging portions 42*e*, thereby improving waterproof function similarly to Embodiments 1 to 3.

The overhanging portions 42*e* preferably overhang in the direction perpendicular to the length direction of the housing fixing portion 42*d* over the entire periphery of the contact but may overhang over part of the periphery of the contact in the direction perpendicular to the length direction of the housing fixing portion 42*d*.

Embodiment 5

While in Embodiment 1 described above, the overhanging portions 12*e* of the contact 12 each have an overhanging surface 12*f* extending in the direction perpendicular to the length direction of the housing fixing portion 12*d*, the overhanging surface need not necessarily extend in the direction perpendicular to the length direction of the housing fixing portion and may extend in a direction inclined with respect to the length direction of the housing fixing portion.

Figure 15:
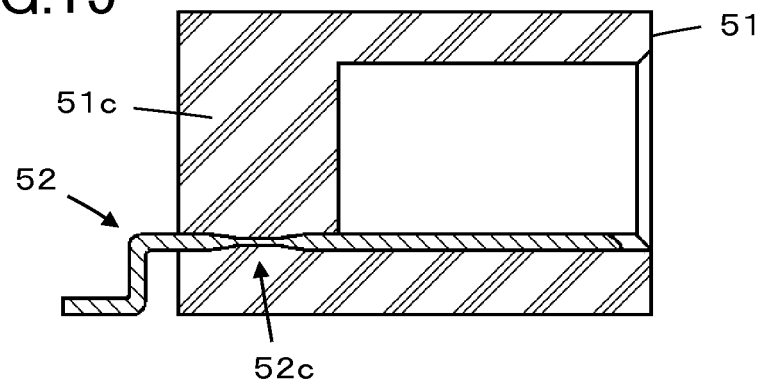
FIG. 15 is a cross-sectional view showing a waterproof connector according to Embodiment 5.

FIG. 15 shows a waterproof connector according to Embodiment 5. A housing 51 made of insulating resin and a contact 52 are formed integrally with each other and an embedment portion 52*c* of the contact 52 is embedded in a rear wall 51*c* of the housing 51.

Figure 16:
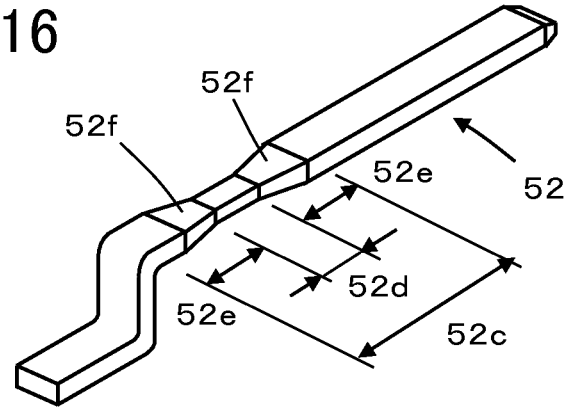
FIG. 16 is a perspective view showing a contact used in the waterproof connector according to Embodiment 5.

As shown in FIG. 16, a housing fixing portion 52*d* having a flat plate shape or a prismatic shape is formed at the middle of the embedment portion 52*c* of the contact 52 and a pair of overhanging portions 52*e* are separately formed at the opposite ends of the housing fixing portion 52*d* to overhang in the direction perpendicular to the length direction of the housing fixing portion 52*d* over the entire periphery of the contact. Each of the overhanging portions 52*e* has overhanging surfaces 52*f* extending in directions inclined with respect to the length direction of the housing fixing portion 52*d*. In other words, the overhanging surfaces 52*f* of the overhanging portion 52*e* each constitute an inclined surface connected to a surface of the housing fixing portion 52*d*.

Since the contact 52 as described above and the housing 51 are formed integrally with each other, the insulating resin making up the housing 51 adheres to the surfaces of the embedment portion 52*c* of the contact 52 while the insulating resin in contact with the surfaces of the housing fixing portion 52*d* is sandwiched between the overhanging surfaces 52*f* of the pair of overhanging portions 52*e*. The overhanging surfaces 52*f* overhang more in the direction perpendicular to the length direction of the housing fixing portion 52*d* with increasing distance from the housing fixing portion 52*d* in the length direction of the housing fixing portion 52*d*. Therefore, the amount of expansion of the insulating resin in contact with the surfaces of the housing fixing portion 52*d* is prevented from becoming larger than the amount of expansion of the housing fixing portion 52*d* at high temperature during, for example, a soldering process while a stress is inhibited from being concentrated at a portion between the surfaces of the housing fixing portion 52*d* and the insulating resin during the ill fitting, thus avoiding the separation of the insulating resin from the surfaces of the housing fixing portion 52*d*. Consequently, excellent waterproof function can be exhibited similarly to Embodiment 1.

Also in Embodiments 2 to 4, the overhanging surfaces of the overhanging portions may be formed to extend in directions inclined with respect to the length direction of the housing fixing portion as with Embodiment 5.

Figure 17:
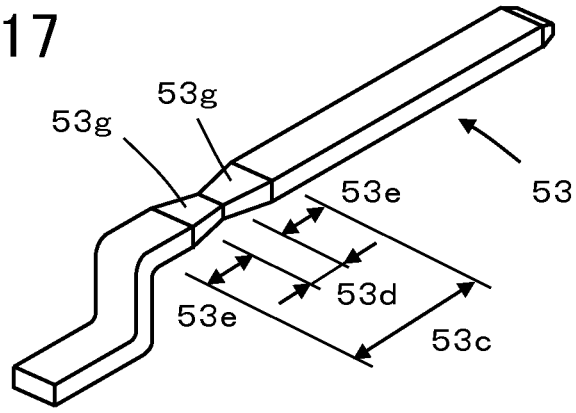
FIG. 17 is a perspective view showing a contact used in a waterproof connector according to a modification of Embodiment 5.

While the contact 52 shown in FIG. 16 is configured so that the housing fixing portion 52*d* of flat plate shape or prismatic shape is formed between the pair of inclined overhanging portions 52*f*, as in a contact 53 shown in FIG. 17, a pair of inclined surfaces 53*g* may abut each other without a portion of flat plate shape or prismatic shape.

In the contact 53, the portion where the pair of inclined surfaces 53*g* abut each other as well as the vicinity thereof is defined as a housing fixing portion 53*d*. Overhanging portions 53*e* are separately formed at the opposite ends of the housing fixing portion 53*d* to overhang in the direction perpendicular to the length direction of the housing fixing portion 53*d* and each include an overhanging surface composed of a part of the inclined surface 53*g*. The housing fixing portion 53*d* and the pair of overhanging portions 53*e* constitute an embedment portion 53*c*.

Even when the contact 53 as described above and the housing 51 are formed integrally with each other, the insulating resin making up the housing adheres to the surfaces of the embedment portion 53*c* of the contact 53 while the insulating resin in contact with the surfaces of the housing fixing portion 53*d* is sandwiched between the pair of overhanging portions 53*e*, thereby improving waterproof function.

While the inclined surfaces 53*g* may be flat as shown in FIG. 17, surfaces of other shapes such as arc-shaped surfaces and spherical surfaces may also be applied.

Embodiment 6

In Embodiment 1 described above, the pair of overhanging portions 12*e* of the contact are respectively formed of portions continuous with the contact portion 12*a* and the board attachment portion 12*b* of the contact 12 and each have the same area as that of the contact portion 12*a* or the board attachment portion 12*b* of the contact 12 in a cross section perpendicular to the length direction of the contact 12, and the housing fixing portion 12*d* is smaller in cross-sectional area than the overhanging portion 12*e*, the contact portion 12*a* and the board attachment portion 12*b*. However, the invention is not limited thereto.

Figure 18:
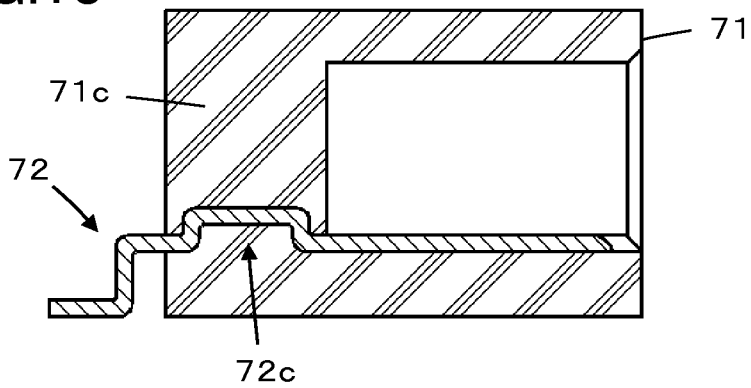
FIG. 18 is a cross-sectional view showing a waterproof connector according to Embodiment 6.

FIG. 18 shows a waterproof connector according to Embodiment 6. A housing 71 made of insulating resin and a contact 72 are formed integrally with each other and an embedment portion 72*c* of the contact 72 is embedded in a rear wall 71*c* of the housing 71.

Figure 19:
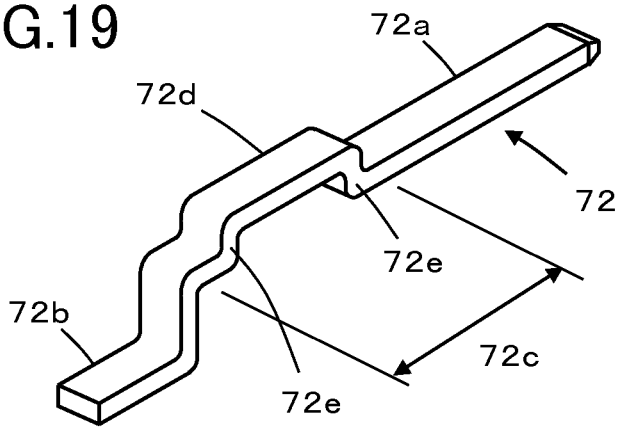
FIG. 19 is a perspective view showing a contact used in the waterproof connector according to Embodiment 6.

The contact 72 is formed by folding a flat plate member having a uniform cross sectional area from a contact portion 72*a* through a board attachment portion 72*b* in a cross section perpendicular to the length direction of the contact 72 as shown in FIG. 19.

A housing fixing portion 72*d* is formed at the middle of the embedment portion 72*c* of the contact 72. The flat plate member making up the contact 72 is folded in the same direction at the opposite ends of the housing fixing portion 72*d* to thereby form overhanging portions 72*e* that overhang in the direction perpendicular to the length direction of the housing fixing portion 72*d*. The embedment portion 72*c* includes the pair of overhanging portions 72*e* as well as the housing fixing portion 72*d*.

Since the contact 72 as described above and the housing 71 are formed integrally with each other, the insulating resin making up the housing 71 adheres to the surfaces of the embedment portion 72*c* of the contact 72 while the insulating resin in contact with the surface of the housing fixing portion 72*d* facing in the direction in which the overhanging portions 72*e* are folded is sandwiched between the pair of overhanging portions 72*e*, whereby the waterproof connector having excellent waterproof function can be obtained.

Embodiment 7

While in Embodiments 1 to 6 described above, the overhanging portions formed at the opposite ends of the housing fixing portion of the contact are defined, together with the housing fixing portion, as the embedment portion and embedded in the rear wall of the housing, the overhanging portions need not necessarily be embedded in the housing.

Figure 20:
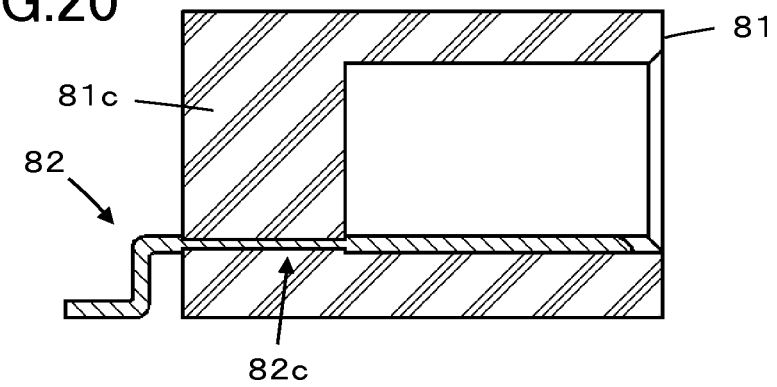
FIG. 20 is a cross-sectional view showing a waterproof connector according to Embodiment 7.

FIG. 20 shows a waterproof connector according to Embodiment 7. A housing 81 made of insulating resin and a contact 82 are formed integrally with each other and an embedment portion 82*c* of the contact 82 is embedded in a rear wall 81*c* of the housing 81.

Figure 21:
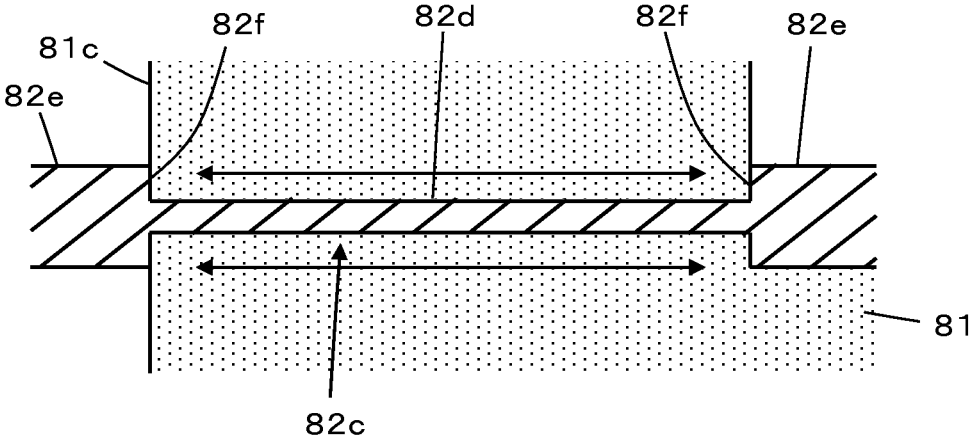
FIG. 21 is a cross-sectional view showing an embedment portion of a contact embedded in a housing of the waterproof connector according to Embodiment 7.
Figure 22:
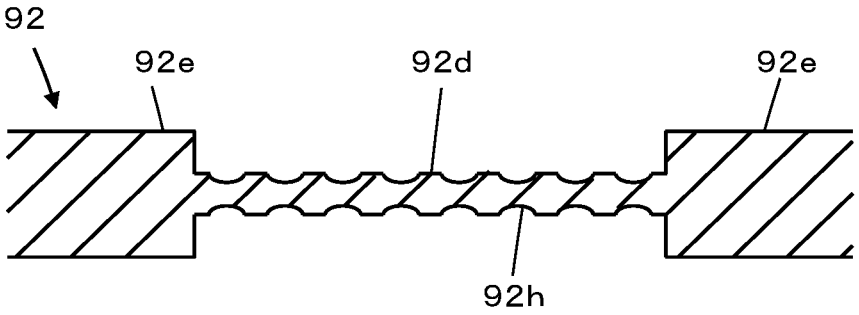
FIG. 22 is a cross-sectional view showing a housing fixing portion of a contact used in a waterproof connector according to Embodiment 8.
Figure 23:
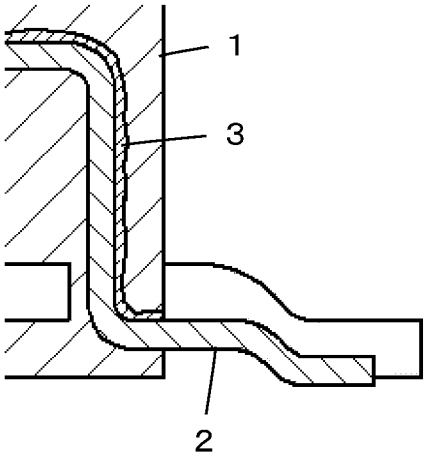
FIG. 23 is a partial cross-sectional view showing the structure of a conventional waterproof connector.

As shown in FIG. 21, the contact 82 has a housing fixing portion 82*d* and a pair of overhanging portions 82*e* separately formed at the opposite ends of the housing fixing portion 82*d* to overhang in the direction perpendicular to the length direction of the housing fixing portion 82*d*, and the embedment portion 82*c* is composed solely of the housing fixing portion 82*d*. In other words, the housing fixing portion 82*d* directly constitutes the embedment portion 82*c*.

The overhanging portions 82*e* formed at the opposite ends of the housing fixing portion 82*d* respectively have overhanging surfaces 82*f* extending in the direction perpendicular to the length direction of the housing fixing portion 82*d* and are disposed outside the housing 81 with the overhanging surfaces 82*f* being in contact with the outer surfaces of the housing 81.

Also with this configuration, owing to the integral molding of the housing 81 with the contacts 82, the insulating resin making up the housing 81 adheres to the surfaces of the embedment portion 82*c*, i.e., the housing fixing portion 82*d*, of the contact 82 embedded in the rear wall 81*c* of the housing 81 while the portion of the insulating resin that is in contact with the surfaces of the housing fixing portion 82*d* is sandwiched between the overhanging surfaces 82*f* of the pair of overhanging portions 82*e*.

Accordingly, even when the waterproof connector is exposed to a high temperature environment during, for example, soldering the connector to a circuit board and the insulating resin in contact with the housing fixing portion 82*d* tries to greatly expand as indicated by arrows in FIG. 21, since the insulating resin is sandwiched between the overhanging surfaces 82*f* of the pair of overhanging portions 82*e*, the amount of expansion of the insulating resin in contact with the surfaces of the housing fixing portion 82*d* is prevented from becoming larger than the amount of expansion of the housing fixing portion 82*d* in the length direction of the housing fixing portion 82*d*. Therefore, the separation between the surfaces of the housing fixing portion 82*d* and the insulating resin is avoided and excellent waterproof function is exhibited between the housing 81 and the contact 82.

Furthermore, even when the ill fitting is performed in which a counter connector is forcibly fitted in a direction oblique to the fitting axis, owing to the insulating resin sandwiched between the overhanging surfaces 82*f* of the pair of overhanging portions 82*e*, a stress is inhibited from being concentrated at a portion between the surfaces of the housing fixing portion 82*d* and the insulating resin, thus avoiding the separation of the insulating resin from the surfaces of the housing fixing portion 82*d* and maintaining excellent waterproof function.

While the overhanging surfaces 82*f* extending in the direction perpendicular to the length direction of the housing fixing portion 82*d* are wholly in contact with the outer surfaces of the housing 81 in FIG. 21, the same effects can be obtained by forming overhanging surfaces formed of inclined surfaces like the overhanging surfaces 52*f* in Embodiment 5 and embedding part of the overhanging portions in the housing 81 so that part of the overhanging surfaces is in contact with the outer surfaces of the housing 81.

Embodiment 8

In Embodiments 1 to 7 described above, fine irregularities 92*h* may be formed at surfaces of a housing fixing portion 92*d* of a contact 92. Alternatively, the surfaces of the housing fixing portion 92*d* may be roughened. When the fine irregularities 92*h* are formed or the roughening is performed, due to the integral molding of the housing with the contact, the anchoring effect is increased with respect to the housing made of the insulating resin and the adhesion between the metal making up the contact 92 and the insulating resin making up the housing is enhanced, thereby more effectively preventing the separation between the surfaces of the housing fixing portion 92*d* and the insulating resin from occurring and further improving waterproof function.

Such fine irregularities 92*h* may be formed or the roughening may be performed at, in addition to the surfaces of the housing fixing portion 92*d*, the surfaces of overhanging portions 92*e* formed at the opposite ends of the housing fixing portion 92*d* to thereby enhance the adhesion between the contact 92 and the insulating resin and improve waterproof function.

REFERENCE SIGNS LIST

1, 11, 21, 41, 51, 71, 81 housing
2, 12, 22, 32, 33, 34, 42, 52, 53, 72, 82, 92 contact
3 waterproof sealant

11*a* front surface
11*b* rear surface
11*c*, 21*c*, 41*c*, 51*c*, 71*c*, 81*c* rear wall
12*a*, 72*a* contact portion
12*b*, 72*b* board attachment portion
12*c*, 22*c*, 42*c*, 52*c*, 53*c*, 72*c*, 82*c* embedment portion
12*d*, 22*d*, 32*d*, 33*d*, 34*d*, 42*d*, 52*d*, 53*d*, 72*d*, 82*d*, 92*d* housing fixing portion
12*e*, 22*e*, 32*e*, 33*e*, 34*e*, 42*e*, 52*e*, 53*e*, 72*e*, 82*e*, 92*e* overhanging portion
12*f*, 52*f*, 82*f* overhanging surface
13 counter connector receiving portion
14 groove
15 casing
16 board
17 opening
18 gasket
53*g* inclined surface
92*h* fine irregularities

The invention claimed is:

1. A waterproof connector comprising:

a housing made of insulating resin; and at least one contact with which the housing is formed to be integral, the contact including a housing fixing portion provided at a middle portion of the contact in a length direction of the contact and embedded in the housing to be fixed to the housing; and a pair of overhanging portions separately provided at opposite ends of the housing fixing portion to overhang in a direction perpendicular to a length direction of the housing fixing portion, wherein the pair of overhanging portions respectively have overhanging surfaces extending in the direction perpendicular to the length direction of the housing fixing portion and are disposed outside of the housing with the overhanging surfaces being in contact with outer surfaces of the housing, and wherein the housing has a portion in contact with the housing fixing portion and the portion of the housing is sandwiched between the overhanging surfaces.

2. The waterproof connector according to claim 1, wherein the contact has at its one end a contact portion formed to come into contact with a contact of a counter connector and at its another end a board attachment portion formed to be attached to a board, and wherein the housing fixing portion is provided between the contact portion and the board attachment portion.

3. The waterproof connector according to claim 2, wherein the housing fixing portion is smaller in cross-sectional area than each of the pair of overhanging portions.

4. The waterproof connector according to claim 1, wherein fine irregularities are formed at a surface of the housing fixing portion for increasing an anchoring effect between the housing fixing portion and the housing.

* * * * *